United States Patent [19]

Jackson

[11] 4,245,809

[45] Jan. 20, 1981

[54] FRAME-FORMING METHOD AND APPARATUS

[76] Inventor: Andrew G. Jackson, 4507 Sunset Ave., Louisville, Ky. 40211

[21] Appl. No.: 937,943

[22] Filed: Aug. 30, 1978

[51] Int. Cl.[3] ..... E04B 1/32; E04B 7/10; E04G 11/04; E04G 17/04

[52] U.S. Cl. ..... 249/15; 52/81; 249/27; 249/30; 249/213; 425/542; 425/546; 425/589

[58] Field of Search ..... 249/27, 56, 30, 213, 249/26, 15; 52/81; 425/542, 546, 589

[56] References Cited

U.S. PATENT DOCUMENTS

| | | | |
|---|---|---|---|
| 944,543 | 12/1909 | Deslauriers | 249/26 |
| 1,191,139 | 7/1916 | Agness | 249/27 |
| 1,279,472 | 9/1918 | Springer | 249/27 |
| 1,510,231 | 9/1924 | Keller et al. | 249/56 |
| 1,963,983 | 6/1934 | Garrett | 249/27 |
| 1,963,984 | 6/1934 | Garrett | 249/27 |
| 2,529,648 | 11/1950 | Borton | 249/27 |
| 2,697,864 | 12/1954 | Banneyer | 249/27 |
| 2,903,389 | 9/1959 | Fujita | 264/102 |
| 3,182,374 | 5/1965 | Cook | 249/27 |
| 3,197,927 | 8/1965 | Fuller | 249/27 |
| 3,255,990 | 6/1966 | Williams | 249/27 |
| 3,898,777 | 8/1975 | Georgiev | 52/81 |

*Primary Examiner*—Wilbert J. Briggs, Sr.
*Assistant Examiner*—Arthur H. Koeckert
*Attorney, Agent, or Firm*—Edward M. Steutermann

[57] ABSTRACT

A structural framing system and apparatus for use in the fabrication of a structural framework of selected geometric configuration of cast material, for example, concrete or plastic. The method and apparatus of the present invention includes a generally hollow hub form defined by a generally continuous shell of selected geometric form to provide a locus for radiating and outwardly extending frame member forms, which communicate with the hub form where a suitable hardenable material is provided to fill the hub form and the frame member forms to provide a self-supporting structural framework of interconnected hubs and frame members, the frame members extending divergently outwardly from the hub members. Structural reinforcements such as reinforcing steel can be attached within the hub to extend divergently outwardly through the frame form members.

17 Claims, 11 Drawing Figures

FRAME-FORMING METHOD AND APPARATUS

BACKGROUND OF THE INVENTION

Previous radial, spherical and space frame construction arrangements have been provided as shown, for example in the geodesic dome construction arrangements generally shown in U.S. Pat. No. 3,197,927 to R. B. Fuller.

Such previous arrangements have generally been provided for geodesic dome construction arrangements or symmetric space frame forms with little variation or diversity of form and shape where the main structural elements are interconnected in a geodesic pattern to approximate great circle arcs intersecting to form a three-way grid. While such previous forms provide significant resistance to internal and radial pressures, because the geodesic dome is a combination of the tetrahedra and the sphere, other symmetric and non-symmetric forms are desirable.

A practical disadvantage of the geodesic dome, as a structural arrangement, has been that its component parts have generally required seams between the beam members which in structures exposed to the atmosphere have provided a situs for leakage in inclement weather. Additionally, while the geodesic dome requires no internal or external vertical or horizontal supports, they generally require parts, fasteners, or adjustability in dimension thereby increasing the cost of such structures through material and labor for assembly of the forms and particularly the supporting forms. Additionally, geodesic dome construction methods require specific bevel angles at the intersections, vertices and joints of adjacent members which requires significant labor and expense.

SUMMARY OF THE INVENTION

The present invention provides a method and apparatus for the construction of a unitary framing system useful for buildings or other similar applications which is self-supporting where a selected number of divergently extending frame members can be provided from a common locus to intersect, without joints, with other similar systems, or sub-unit, unit or super-unit forms or combinations of the foregoing. In addition, the components of the apparatus may be made as small as possible for microstructures or the components can be enlarged for macrostructures. Furthermore, the present method and apparatus is further useful in the fabrication of a continuous shell of castable material. Unitary frames within the scope of the present invention can further be adapted, for example, by provision of rabbets around the edge of the frame members, to integrally accept panels to provide walls, insulation, windows, vents, interior finish, doors, etc. Additionally, the present system can be used to cast interior walls, floors, etc., continuous and monolithic with the cast structure.

Furthermore, the method and apparatus of the present invention provides a frame casting means which, when for example, applied to consumer housing, results in a decrease in material and labor expense in fabricating the structural features of the building. Specifically, the method and apparatus of the present invention can provide a frame form assembly which is self-supporting, utilizes up to 50% less forming material and has increased structural stability resulting from its monolithic nature and the flexibility in the design of systems in accordance with the present invention, where such systems in accordance with the present invention can be symmetrical or asymetrical.

More particularly, the methods and apparatus in accordance with the present invention provide forms for a frame of structural frame members extending divergently from central hub forms, where the hubs can be disassembled for re-use, after the material of which the structure is formed hardens, where the hubs are congruent to and enclose the vertex of the intersection of the frame members. The hub provides a central core or locus for the extension of the frame members where the frame members can be curved, convex, concave, open, closed, free-form or straight.

More particularly, the present invention provides a frame-forming system for fabricating a structural framework which includes a hub form which includes aligned disassembable spaced shell plates or faces that can be fabricated of various suitable materials such as wood, sheet metal, plastic, paperboard, etc., where the plates are adapted to be received in spaced relation to define a hollow chamber and also provide openings adapted to receive divergently extending hollow frame form members adapted to receive a castable material within the openings where reinforcing members can be disposed longitudinally within the frame members and fastened to a core body located within the hollow chamber of the hub member so that after the hub form and frame member forms have been removed from the cast structural framework, the core body's central rod, which can be threaded for fastening purposes, remains imbedded in the hub at the vertex or intersection of the frame members while extending outwardly therefrom. In some arrangements in accordance with the present invention, protruding ends of the rod can be utilized to provide fastening means to hold the form pans or plates for casting intermediate shell areas between the frame members in the open network or framework and can later be used to attach other materials of a suitable nature, such as insulation, panelling, or appurtenant facilities. Structural frameworks in accordance with the present invention are formed from castable material which for purposes of the present invention comprehends any material which flows into a form or mold and changes form to a self-supporting character.

Various other features of the present invention will become obvious to those skilled in the art upon reading the disclosure set forth hereinafter.

BRIEF DESCRIPTION OF THE DRAWINGS

Several examples of arrangements within the scope of the present invention are shown in the accompanying drawings in which:

Referring now to FIG. 1, which shows an assembled set of frame member forms and hub forms in accordance with the present invention to provide the structural framework for a pyramidal roofed structure, the arrangement shown includes horizontal connecting frame member forms 11 extending between hub corner forms 6. The horizontal frame member forms are adapted to receive a setable material, for example, concrete, where when the forms are removed, generally horizontally extending frame members remain. The corner hub forms are provided with flanged openings 6A, 6B to receive horizontal frame member forms 11 in communicative relation with a chamber defined within the corner hubs 6, as described hereinafter, and the corner hubs are further provided with inclined flanged openings 8 to receive inclined frame member forms 2, which provide the structural members for the roof to be provided on the structure, where one inclined flange 8 is provided for each corner hub. Corner hubs 6 are supported by vertical frame member forms 4 which provide the forms for the vertical support members of the structure. Roof frame member forms 2 extend between flanges 8 of corner hubs 6 and are communicatively connected with a hub shell 1 having downwardly depending flange receptacles 5 to receive the end of forms 2, the opposite end of each form 2 received in a flange 8 of corner hub 6.

Figure 1:
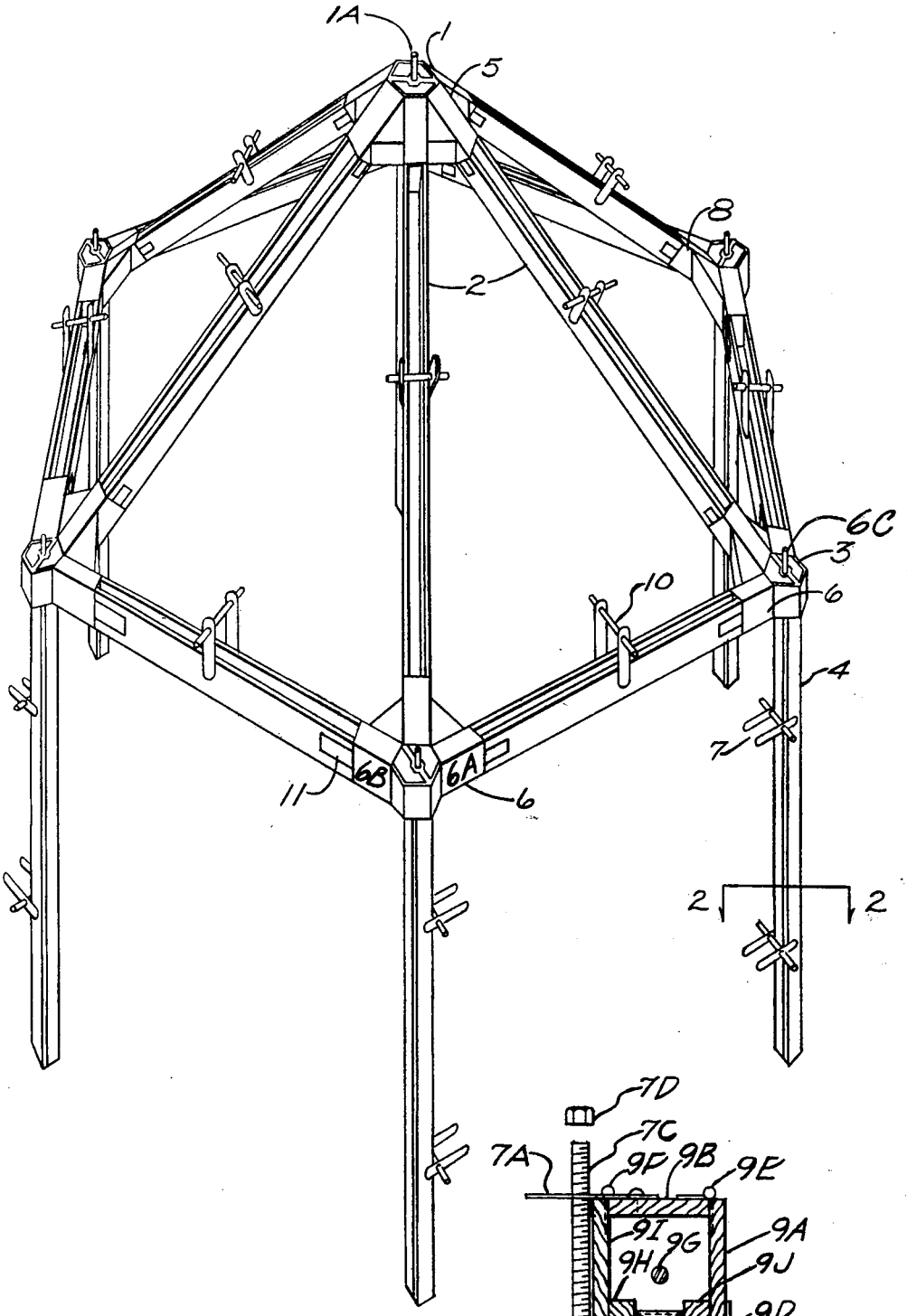
FIG. 1 is a perspective view of one assembled form arrangement in accordance with the present invention.

In accordance with one feature of the present invention, a rod member 6C extends upwardly and downwardly into form 4 out of each corner hub 6 and a rod 1A extends outwardly from hub shell 1 and can extend downwardly therefrom.

Within the scope of the present invention, the frame member forms and hub forms are removable after the material of which the structure is fabricated has set and the forms can be removed for re-use or, in some cases, can be discarded.

To maintain the frame member forms in the proper orientation, clamps 7 are provided for the vertical frame member forms and clamps 10 are provided for the horizontal frame member forms.

Figure 2:
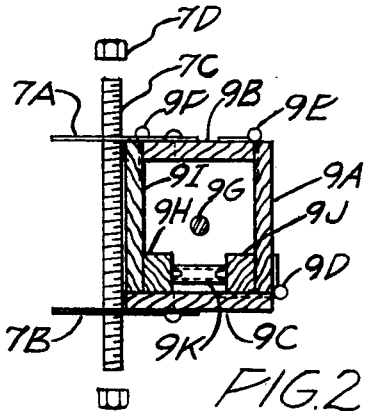
FIG. 2 is a view taken along a plane passing through line 2—2 of FIG. 1.

It will be recognized that in the structure shown, where the frame member form is disposed with a vertical component, or where deemed applicable, a fully enclosed form is necessary, and, as shown in FIG. 2, one arrangement to provide a fully enclosed removable frame member form is shown.

Referring to FIG. 2, a base member 9I is provided and connected to a wall member 9B by means of a hinge 9F where wall 9B is also connected to a wall member 9A by means of a hinge 9E and the final wall member 9C is connected to wall member 9A by a hinge 9D so that the frame member form can, by means of the hinges, be released or, alternatively, placed into position as shown in FIG. 2.

A reinforcing member, for example, a steel reinforcing bar 9G, can be provided within the core of the form to provide additional strength to the finished member. Also, where needed, blocks 9H and 9J can be provided, as shown, to provide a rabbet along the length of the frame member as formed. Where desirable, sleeves 9K can be provided to extend between blocks 9H and 9J to provide openings for attachment of other features between the vertical frame members. The entire frame member form can be held together by means of brackets 7A and 7B attached to walls 9B and 9C, as shown, and can extend outwardly therefrom, to receive a threaded fastener 7C adapted to receive nuts 7D to hold the structure in shape while the castable material is poured into the chamber defined by the hollow hub form to harden. It will be understood that the castable material can be pumped or drawn into the form by vacuum.

The structures shown in FIGS. 1 and 2 are intended merely as illustrations of a simple configuration in which the arrangements provided by the present invention are applicable and it will be understood that numerous structures can be provided in accordance with the present invention, where the configurations are infinitely more complicated, but where the features of the present invention are utilized to form an intricate, and extensive frame structure.

Figure 3:
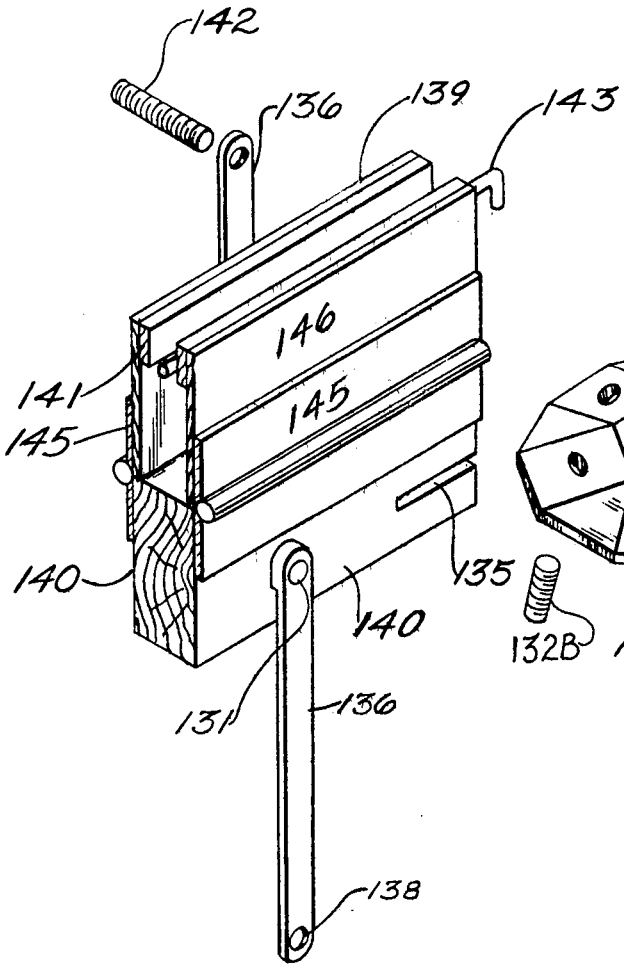
FIG. 3 is an illustration of a partial section of a frame member form arrangement useful in fabricating structures within the scope of the present invention.
Figure 4:
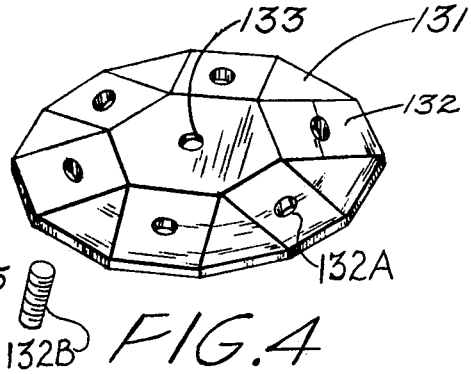
FIG. 4 is an illustration of one hub base form arrangement useful in forming structures in accordance with one feature of the present invention.
Figures 5, 9:
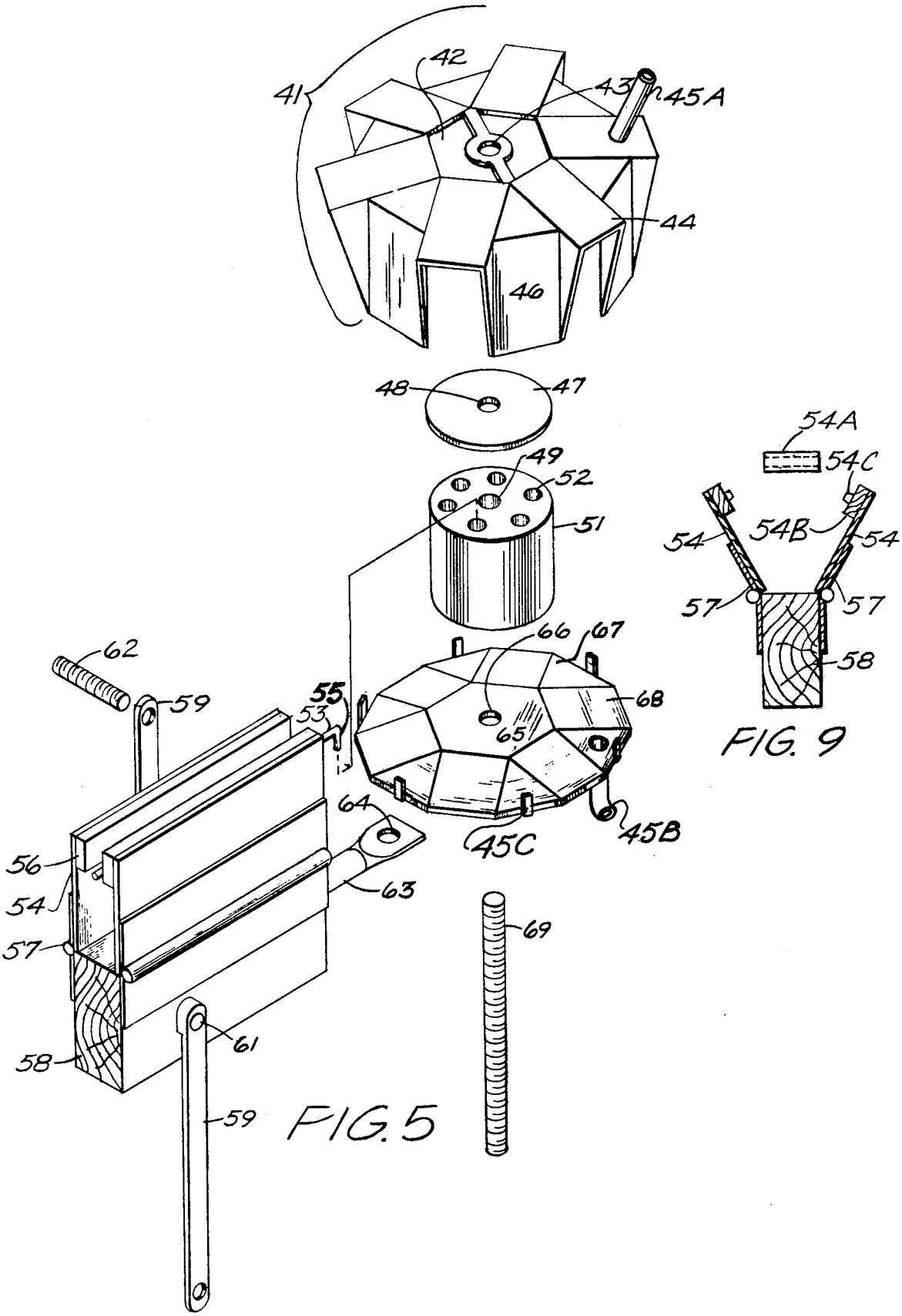
FIG. 5 is a partially exploded, perspective view of another hub and frame member form arrangement in accordance with the present invention.
FIG. 9 is a cross-sectional illustration of the operation of an example of a frame member-forming apparatus in accordance with the present invention.

Referring now to FIGS. 3 and 4, which illustrate another frame member arrangement where an open top frame member form is used and is adapted to be used in conjunction with a hub arrangement of the type shown in FIG. 5, the frame member form is supported on a support member, for example, a wooden support 140 where a notch 135 is cut longitudinally in the support member form at the end thereof and is adapted to be received on faces 132 of a base plate for a hub form arrangement (details not shown). The hub base in FIG. 4 includes six faces 132, each adapted to receive a frame member form and where a center hole 133 is provided to receive the vertical rod (not shown) but referred to hereinafter. Also, each face 132 can include an aperture 132A where a pin 132B can be provided to be inserted through cooperative aperture (not shown) in base 140 to secure the base to the hub base. Triangular spaces 131 are provided between the faces 132 to provide structural stability and in the arrangement shown facilitate manufacture of the hub base. The configuration of spacers 131 also determines the angle of inclination of faces 132 as well as the angle and degree of inclination of frame forms for example form 140 attached thereto as described hereinafter.

Hinges 145 can be connected to base member 140 to open outwardly therefrom and connected to wall members 146 which provide the defining surfaces of the frame member form. As in the case of the illustrations shown in FIG. 2, blocks 141 can be provided to extend longitudinally along a portion of the upper edge of walls 146 to define a rabbet along one surface of the frame member cast in the form.

Arms 136 are connected to base 140 by means of pivot 131 to be rotated from a downward, side open position to an upward position as also illustrated where a pin 142, which can be provided with two end nuts not shown, is adapted to be received through apertures 138 of arms 136 to retain the walls of the frame member form in position to receive the material to be cast.

In some cases where necessary, the frame form wall members 146 can be released by cooperatively adapting the hinge members so the wall members are released by removing the hinge pins.

A reinforcing bar 143 can be provided to be disposed within the chamber defined by the frame member form to further support the cast frame member.

FIG. 5 is an illustration, in exploded form, of one example of an assembly method utilized in assembling a frame member and hub form for the arrangements shown in FIGS. 3 and 4, which has a hub base plate 65 provided with frame member form receiving faces 68 disposed around the periphery of base plate 65 where triangular spacers 67 are provided between faces 68 and an aperture 66 is provided in the center of base plate 65 to receive a threaded rod 69 as previously described. A frame member form supported on a base 58 having wall members 54 connected to base 58 by means of hinges 57 or other means (not shown) is provdied to define a channel to receive castable material to form a frame member where, as previously described, blocks 56 are provided at the inner surface of the wall members 54 and in the example shown the rabbets are along the upper edges of wall members 54 to define a rabbet in the finally formed frame member. Wall members 54 can be secured in an upright position, for example by pivotal levers 59 provided to be pivoted on pivots 61 to an upstanding position to support the wall members 54 in vertical orientation where arms 59 are adapted to receive a rod 62 where a nut (not shown) can be provided for each end to hold the arms in the upright position.

As an illustration of an alternative arrangement in accordance with the present invention, a tongue 63 is connected to base 58 and includes an aperture 64 adapted to receive rod 69 where aperture 64 is advantageously disposed to be located in aligned relation with aperture 66 of hub form base plate 65 when base 58 of the frame member form rests on one of the edges of faces 68. It will be recognized that when multiple frame forms are utilized it may be necessary to compensate for the space occupied on rod 69 by overlying ends of tongues 63 and that, for example such compensation can be accomplished by providing bases 58 of different heights.

Within the scope of the present invention the castable material may be pumped into the hub to flow into the frame forms or, in applications where the frame forms and hubs are completely enclosed, a vacuum inlet 45A and 45B can be provided so a vacuum can be applied to the hub assembly to draw the castable material into the system. The inlets can also be used to pump castable material into the assembly. To facilitate vacuum filling, 45C can be provided to locate shell 41 on base 65 and means (not shown) can be provided to seal the bottom edge of shell 41 to base 65.

As previously described, reinforcing rod 53 is provided to be disposed in the cavity formed between wall members 54 to provide reinforcement for the cast frame member and includes a downwardly turned hook 55. However, it is not intended that the disclosure be limited to this method of attachment. In accordance with one feature of the present invention, an inner locus core body 51 is provided having apertures 52 spaced advantageously so that each aperture 52 receives a hook 55 coming out of a frame member form to connect the reinforcing member to the inner locus core body. Core body 51 further includes a central aperture 49 adapted to receive rod 69 when the hub is assembled and a washer 47 having a cooperative aperture 48 is provided along with a nut (not shown) to be received on rod 69 to hold the hooks 55 in place in apertures 52 when the entire arrangement is assembled.

A shell 41 having divergently outwardly extending flanges 44, advantageously adapted to receive the walls of frame member form 54 aligned on the flanges is provided and a central aperture 43 is provided in shell 41 to facilitate assembly of the entire arrangement. An opening 42 can be provided in the upper surface of shell 41 and, advantageously, the material to be cast, for example concrete, is poured into the form through openings 42 to flow outwardly through the frame member forms and fill the cavity within the hub form chamber. The material further flows out of the hub form chamber into frame forms 54.

Spacers 46 are provided between flanges 44 and the bottom of each is adapted to be received on the outer surfaces of spacers 67 of base plate 65.

Referring to FIG. 9, which illustrates a slight modification in a frame member form similar to the frame member form illustrated in FIG. 5, a sleeve 54A is provided to be received on posts 54C of blocks 54B, provided to form the rabbets in the upper edge of the frame member, where sleeves 54A are provided to define apertures extending transversely through the frame member at the outer surface thereof to provide fastening means for panels or other items to be attached between adjacent frame members.

Figure 6:
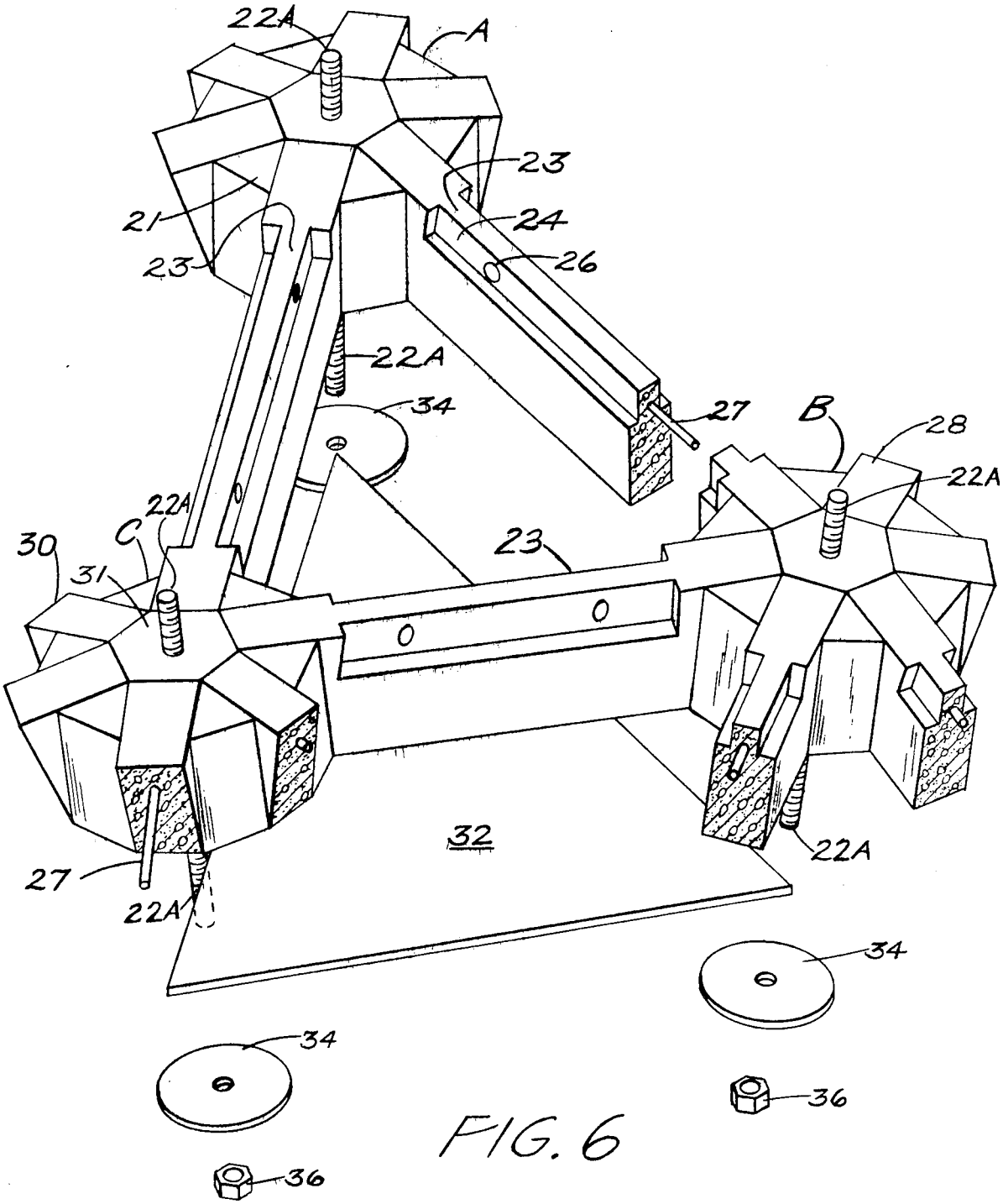
FIG. 6 is an illustration of a portion of a structural frame provided by the present invention.

FIG. 6 is an illustration of a frame member form cast from a larger system of connected hubs of the type shown in FIG. 5 where hubs A, B and C are shown and each is similar to the type hub which would be cast from an assembled form arrangement utilizing the forms illustrated in FIG. 5. In the structure shown in FIG. 6, frame members 23 extend divergently outwardly from hubs A, B and C. The frame members illustrated are interconnected between hubs A and B, A and C, and B and C while other frame members 30 (cut off) extend out from hub C while other frame members 28 (cut off) extend outwardly from hub B. Rod 22A extends outwardly from hub A while rod 22A extends outwardly from hub B and rod 22A extends outwardly from hub C. Frame member 23 is an illustration of a structural member cast utilizing the frame member form illustrated in FIG. 9 where apertures 26 are provided extending transversely through the frame member into rabbets 24 which are defined by blocks 54B of FIG. 9.

Reinforcing rod 27 is shown and it will be noted that the core body similar to core body 51 of FIG. 5 is completely enclosed in each of the hubs A, B and C to secure the reinforcing rods in position.

FIG. 6 is a further illustration of an arrangement where the space between the frame members 23 is to be filled with a cast material. In this regard, a cooperatively shaped form member 32 is provided which can be secured between frame members 23, by means of washers 34 which are disposed beneath member 32 and nuts 36 are drawn up on rods 22A to secure the member 32 in position prior to pouring a selected material into the cavity defined between frame members 23 and above member 32. The material cast in the cavity can be concrete or, if desired, plastic or other material which can be hardened to provide a shell member. It will be recognized that when the structure shown is inclined relative to the horizontal or where deemed applicable it is necessary to provide a form member 32 on each side of the frame assembly.

Figure 7:
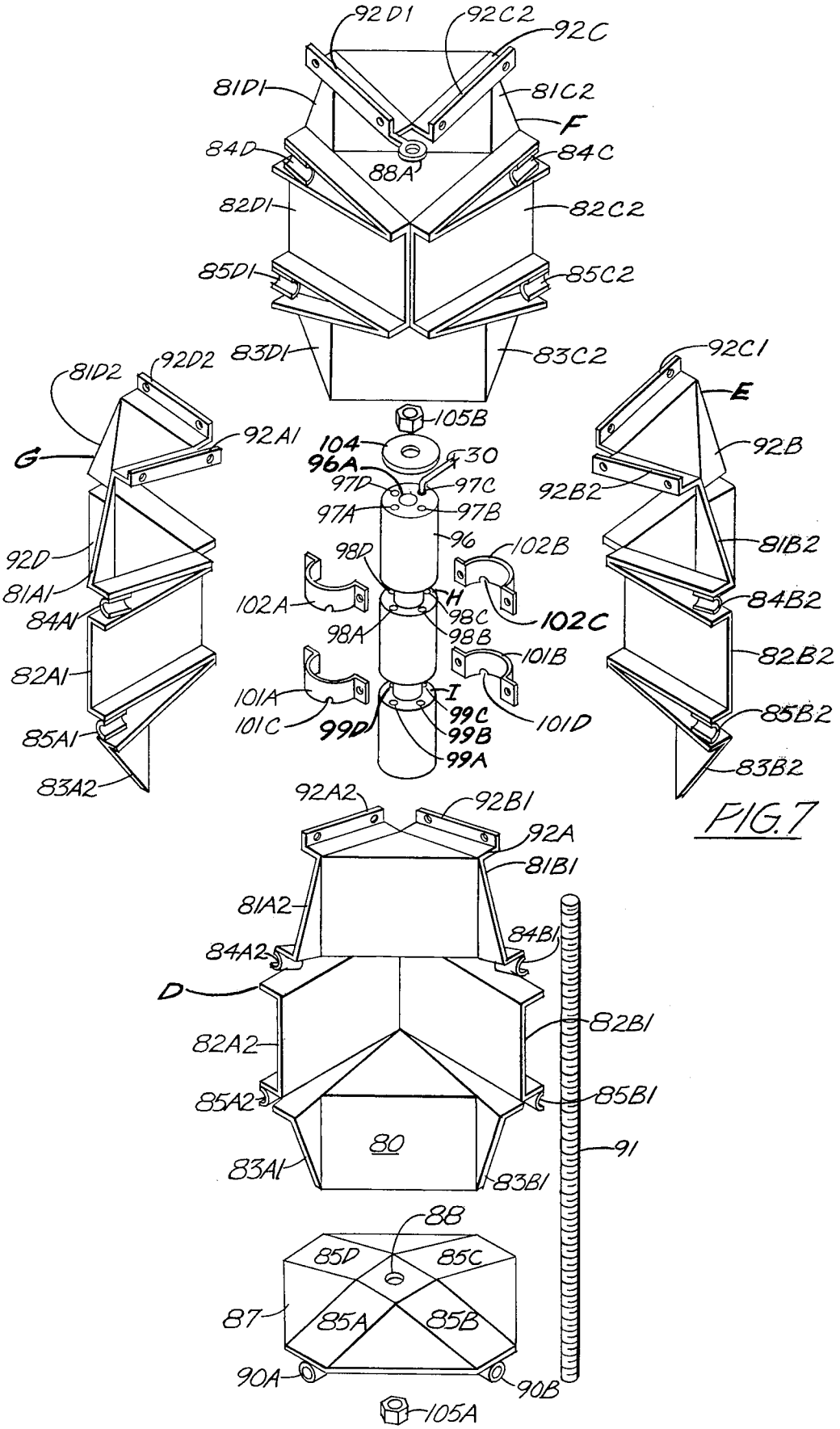
FIG. 7 is an exploded, perspective view of one hub form arrangement useful in forming a frame structure in accordance with the present invention.
Figure 8:
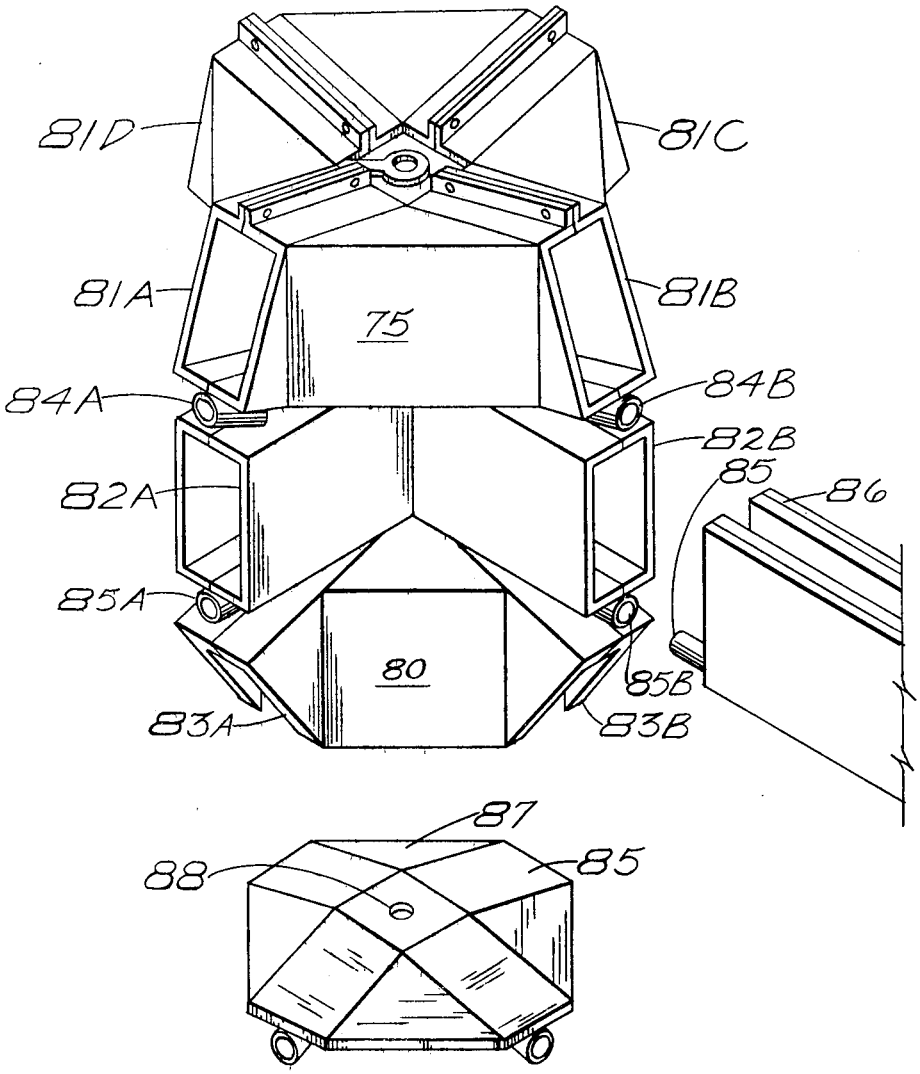
FIG. 8 is an illustration of the assembled hub form shown in FIG. 7.

FIGS. 7 and 8 illustrate another hub form arrangement within the scope of the present invention where frame members are adapted to extend divergently outwardly from the hub on different levels of elevation and at different angles of inclination. In practice any number of elevations can be provided depending upon the size and configuration of the hub form.

In this regard, referring to FIG. 7, a base plate 87 is provided having frame member receiving faces 85A-D. In the arrangement shown, the type frame member shown in FIG. 8 can be utilized where a connector 85 is provided to be received within apertures defined by the assembled form as described hereinafter.

The hollow hub form is assembled of four separable pieces, D through G, which can be connected together, for example, by cooperative flanges 92B-1, 92B-2, 92C-1, 92C-2, 92D-1, 92D-2, and 92A-1, 92A-2 where cooperative apertures are provided to receive bolts (not shown).

Referring to FIG. 8, the assembled hollow hub form includes three levels of divergently extending flanges 81 (81A–81D) which is inclined upwardly, 82A–82D which are generally horizontally disposed and 83A–83D which are downwardly depending.

Referring again to FIG. 7, assembly of the unit will be described with respect to elements D and E where flange opening 81B is defined by cooperative shell sections 81B-1 and 81B-2 when the unit is assembled and an aperture 84B (FIG. 8) is formed between half-sleeves 84B-1 and 84B-2 to receive the support for a frame member form as described hereinafter. Likewise, flange opening 82B (FIG. 8) is defined between shell sections 82B-1 and 82B-2 while a support receptable member is formed by semi-circular cylinders 85B-1 and 85B-2. The flange opening 83B (FIG. 8) is formed between shell sections 83B-1 and 83B-2 which are advantageously received on face 85B of base plate 87 where a cylinder support 90B is provided beneath face 85B. It will be understood that the foregoing explanation applies equally to the other flange openings to receive cooperative frame member forms.

Hollow hub form element F further includes a cooperative aperture 84A adapted to receive a threaded rod 91 which also extends through an opening 88 of hub form base 87 where a nut 105A is provided to be secured to the lower end of rod 91 to retain the bottom side of base 87.

In accordance with another feature of the present invention, an inner locus core 96, for example, machined or cast from steel or other suitable material, is provided having grooves H and I where apertures 97A–97D are provided in the top of core 96, apertures 98A–98D are provided in groove H and apertures 99A–D are provided longitudinally in core 96 at groove I to receive the hook ends of reinforcing rods, for example, reinforcing rod 30 which would extend through flange opening 81C. A washer 104 along with a nut (not shown) is provided to be received on top of core 96 to retain the ends of the reinforcing rods in apertures 97A–97D. Advantageously, clamps, for example, clamps 102A and 102B are are provided to be connected together and received within groove H where each clamp is provided with notches 102C to receive reinforcing rods corresponding to rod 30 where the hook end of the reinforcing rod is received in apertures 98A–98D. The assembled inner locus core body is then disposed within the chamber of the hub form assembly and rests on base plate 87. The core body assembly includes a central aperture 96A to receive rod 91 which is also received by washer 104 and a nut 105B can be provided to hold the entire assembly in position on base 87. Rod 91 also extends outwardly through apertures 88A and a top nut (not shown) can be provided to secure the entire core body assembly in position.

Referring now to FIG. 8, which shows the assembled hub of FIG. 7, a frame member form 86 is provided having a connector shaft 85 to be received in aperture 85B to support the frame member form in communication with the hub assembly. Within the scope of the present invention shaft 85 can extend the full length of frame forms 86 and can be interconnected in a sub frame assembly.

Figure 10:
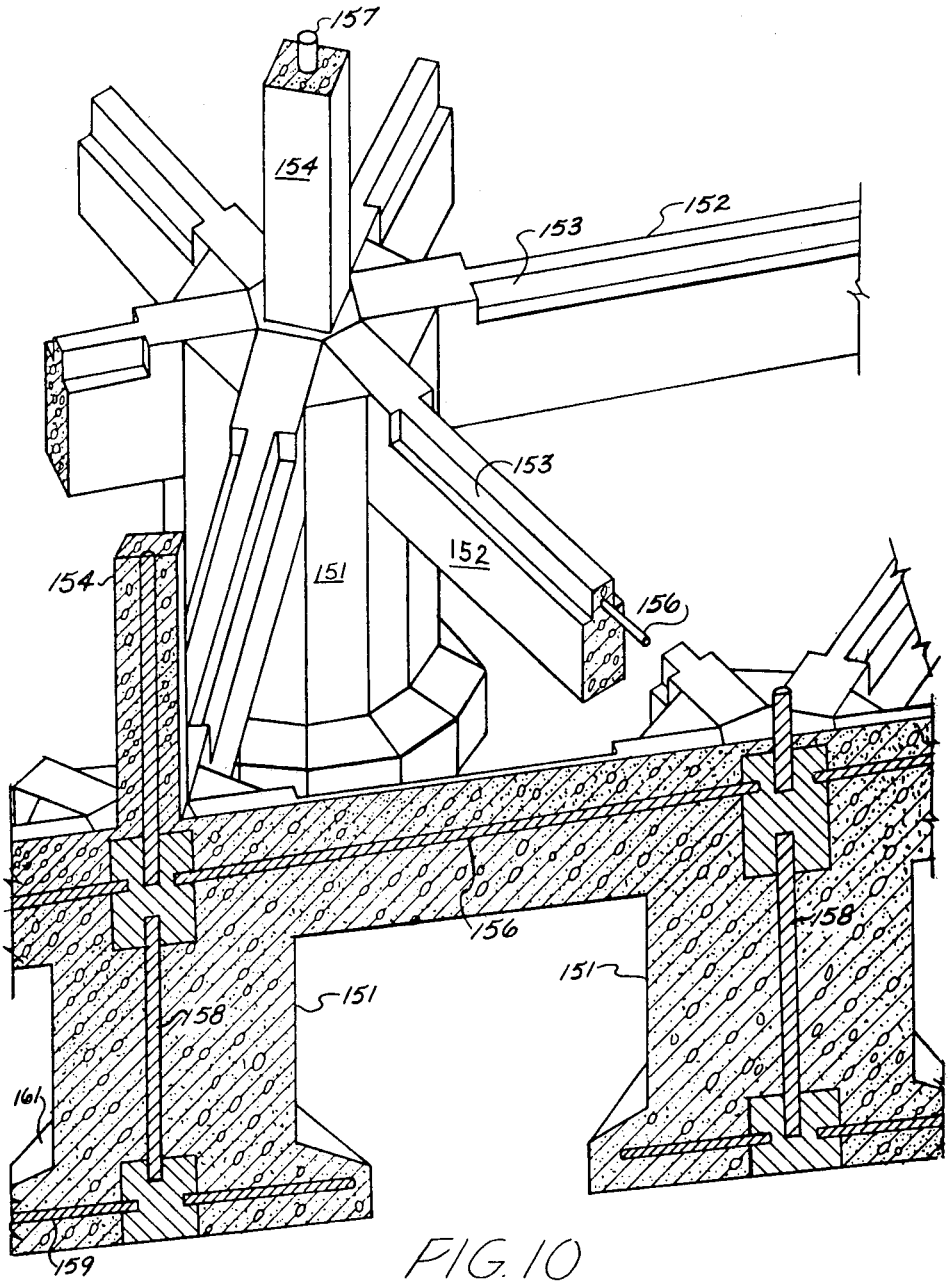
FIG. 10 is a perspective view of a section illustrating another application of the present invention.

FIG. 10 is a view of a structural framework formed with apparatus in accordance with the present invention which can, for example be utilized as the foundation for a structure, where pier foundations 151 can be formed from the hub form and interconnected by horizontal frame members 152 which can provide floor joists. Within the scope of the present invention the floor can be of a cast material poured between the frame members, or can be panels laid in rabbets 153 or any other suitable arrangements.

The structure shown can within the scope of the present invention include outwardly extending frame members 154 which can for example be utilized to secure or cast for example interior or exterior wall members (not shown).

Reinforcing rods 156 can be provided in frame members 152 while additional reinforcing rods 157 can be provided in frame members 154. Additionally, reinforcing rods 158 can be provided in piers 151 and rods 159 can be provided to extend outwardly into footings 161 of piers 151.

Figure 11:
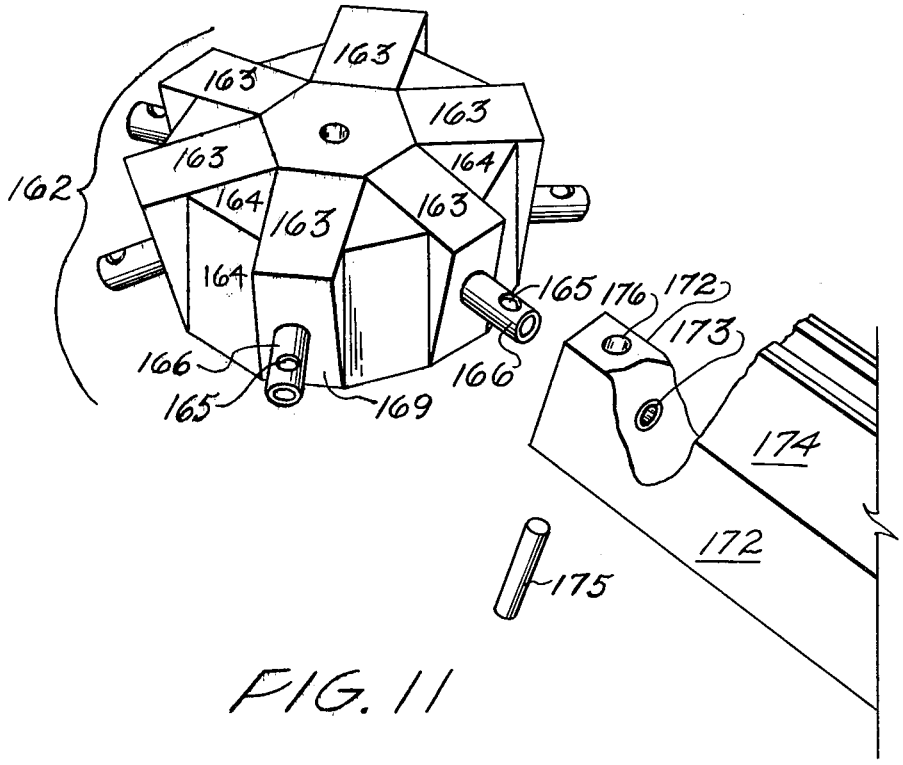
FIG. 11 illustrates another example of an arrangement in accordance with the present invention.

FIG. 11 is a view of a portion of another feature within the scope of the present invention where a hub base 162 for example cast of concrete or steel is provided having base sections 163 with spacers 164 and adapted to receive a hub shell (not shown). The faces 169 of base sections 163 can be inclined to receive the end of base member 172 carrying a frame form 174 to provide proper angular orientation to frame form 174. As shown, shafts 166 can be provided to protrude from faces 169 to be received in cooperative apertures 173 of base 172 where base 172 can be provided with transversely extending apertures 176 adapted to receive a cooperative pin 175 which is also received in aperture 165 of shafts 166 to secure the assembly. Pin 175 can be secured in aperture 176 by any suitable means, for example by providing cooperative thread means in a portion of aperture 176 and on pin 175 (not shown).

The foregoing are but a few examples of arrangements within the scope of the present invention. It will be understood that, within the scope of the present invention, various other arrangements will occur to those skilled in the art.

The invention claimed is:

1. A form arrangement for use in a structural framing system to cast a structural frame work of a selected castable material where the form arrangement includes:

(a) a generally hollow hub form defined by generally continuous shell means of selected geometric configuration and having at least one first aperture therein and defining a hub chamber therein where said aperture communicates with said hub chamber;

(b) at least one elongate frame member form of channel shape cross section extending outwardly from said hub and having at least one open end where said open end is received in communicative relation by one of said first apertures so said castable material can flow between said hub chamber and said frame member form; and (c) reinforcing rod receiving means located within said hub chamber to receive an end of a reinforcing rod means and direct said reinforcing rod means outwardly through said aperture of said frame member.

(d) frame securing rod means to be received within said hub form by the said reinforcing rod receiving means and to extend outwardly substantially beyond the structural framework to be cast and adapted to receive selected structural members and to secure same.

2. The invention of claim 1 wherein said hub form includes:

(a) a hub base member of selected geometric configuration; and (b) generally continuous shell means having base opening therein adapted to receive said hub base member, where said shell means is provided with at least one of said first apertures.

3. The invention of claim 2 wherein said base means includes cooperative aperture means where said frame securing rod means is received within said aperture and is adapted to extend into said hub chamber, and fastener means to secure said reinforcing rod receiving means to said frame securing rod means where said frame securing rod means extends outwardly through said shell means.

4. The invention of claim 3 wherein said reinforcing rod receiving means includes a solid of selected geometric configuration having aperture means therein adapted to receive said frame securing rod means and at least one cooperative second aperture adapted to receive the end of selected reinforcing rod means.

5. The invention of claim 4 wherein said frame member form includes spaced first and second wall means releasably connected to a frame base means along a portion of the length thereof on opposite sides thereof in spaced parallel relation to define hollow channel of selected geometric cross section.

6. The invention of claim 5 wherein rabbet forms are provided on the inner surface of said wall means to extend along a portion of the length thereof and inwardly into said hollow channel.

7. The invention of claim 2 wherein multiple apertures are provided in said shell means at selected locations and frame member form means are provided to be received in communicative relation with each aperture and extend divergently outwardly from said shell means.

8. The invention of claim 3 wherein tongue means are provided to extend longitudinally from said frame member form means toward and beneath said hub base member and wherein said tongue means includes aperture means adapted to receive said rod means where said aperture means is located in said tongue means to retain said open end of said frame member form means in communicative relation with one of said shell aperture means.

9. The invention of claim 2 wherein said shell means is composed of multiple cooperative sections to be assembled to form said shell means.

10. The invention of claim 2 wherein multiple frame member form means are provided and extend radiating divergently outwardly from said hub member at at least two angles of inclination relative to a plane passing through said hub form member.

11. The invention of claim 2 including opening means to said shell means for introduction of castable material.

12. The invention of claim 2 wherein shell means includes aperture means to receive said rod.

13. The invention of claim 1 including at least one first hub arrangement and at least one second hub arrangement inter-connected by first frame form means where one open end of said first frame form means communicates with an aperture of the shell of said first hub arrangement and an opposite open end of said first frame form means communicates with an aperture of the shell of said second hub arrangement.

14. The invention of claim 13 including at least one third hub means connected by second frame form means and to said first hub means by third frame form means and form means to admit castable material to the space defined between said first, second and third hub means to form a surface therebetween.

15. The invention of claim 3 wherein said frame securing rod means radiate and extend outwardly from said hub form and where said outwardly extending portion is threaded.

16. The invention of claim 1 wherein said hub form is selectively closed and generally airtight and includes means to draw said castable material into said hub means at negative pressure relative to atmospheric pressure.

17. The invention of claim 1 including means to supply castable material to said hub means at positive pressure relative to atmospheric pressure.

* * * * *